United States Patent [19]

McMunn et al.

[11] 4,079,990

[45] Mar. 21, 1978

[54] WHEELCHAIR

[76] Inventors: Earl E. McMunn, 972 Park Ave. NE.; Ronald N. McMunn, 4747 Caroline Ave. NE., both of Salem, Oreg. 97301

[21] Appl. No.: 677,558

[22] Filed: Apr. 16, 1976

Related U.S. Application Data

[63] Continuation-in-part of Ser. No. 646,349, Jan. 2, 1976, abandoned.

[51] Int. Cl.[2] ..... A47C 1/035

[52] U.S. Cl. ..... 297/69; 297/86; 297/91; 297/322; 297/DIG. 4

[58] Field of Search ..... 297/86, 90, 91, 317, 297/320, 321, 342, 434, 436, DIG. 4, 68–71, 75, 83, 318, 322, 341; 5/81 R, 81 B; 248/220.3, 220.4; 16/172

[56] References Cited

U.S. PATENT DOCUMENTS

| | | | |
|---|---|---|---|
| 263,636 | 8/1882 | Weiss | 16/172 X |
| 360,279 | 3/1887 | Case | 297/69 |
| 1,589,507 | 6/1926 | Bond | 16/172 |
| 1,748,784 | 2/1930 | Mierley | 297/90 |
| 2,375,151 | 5/1945 | Troxell | 297/70 X |
| 2,676,643 | 4/1954 | Miller et al. | 297/70 X |
| 3,147,039 | 9/1964 | Smith et al. | 297/90 |
| 3,329,978 | 7/1967 | Porter et al. | 5/81 R |
| 3,495,869 | 2/1970 | Insemansson | 297/91 X |
| 3,792,500 | 2/1974 | Swara Sr. | 5/81 B |
| 3,853,372 | 12/1974 | Meyer | 297/DIG. 4 X |
| 3,927,430 | 12/1975 | Allen | 5/81 R |
| 3,936,893 | 2/1976 | Anderson et al. | 297/90 X |

FOREIGN PATENT DOCUMENTS

| | | | |
|---|---|---|---|
| 528,052 | 7/1956 | Canada | 16/172 |

*Primary Examiner*—Roy D. Frazier
*Assistant Examiner*—William E. Lyddane
*Attorney, Agent, or Firm*—Oliver D. Olson

[57] ABSTRACT

A wheelchair includes a main frame supported on front and rear pairs of wheels, the main frame pivotally mounting pivotally interconnected back rest, seat and leg rest frame segments in such manner as to allow said segments to be adjusted between positions supporting a patient in upright sitting position and in fully reclining position, without the necessity of first removing or otherwise requiring physical participation of the patient.

5 Claims, 9 Drawing Figures

WHEELCHAIR

CROSS REFERENCE TO RELATED APPLICATION

This application is a continuation-in-part of our earlier application, Ser. No. 646,349 filed Jan. 2, 1976, now abandoned.

BACKGROUND OF THE INVENTION

This invention relates to wheel chairs, and more particularly to a wheelchair capable of being adjusted between positions supporting a patient in upright sitting position and in fully reclining position.

The transfer of an incapacitated person from a bed into a wheelchair, or from a wheelchair into a bed, heretofore has required that two or more attendants lift the person bodily from the bed to the chair, or from the chair to the bed. Such manipulations obviously are very awkard and hazardous, in that the attendants can incur back and other injuries and the person being lifted may be dropped or otherwise injured.

SUMMARY OF THE INVENTION

In its basic concept, this invention provides a wheelchair in which the back rest, seat and leg rest are adjustable between positions supporting a patient in upright sitting position and in fully reclining position.

It is by virtue of the foregoing basic concept that the principal objective of this invention is achieved; namely, to overcome the disadvantages and limitations of prior patient transferring procedures.

Another important objective of this invention is the provision of a wheelchair of the class described which is adjustable between the upright sitting and fully reclining positions with minimum effort of a single attendant.

A further important object of this invention is the provision of a wheelchair of the class described in which the fully reclining position places the supported patient substantially at the height of a bed to or from which the patient is to be transferred.

Still another important objective of this invention is the provision of a wheelchair of the class described which is capable of being collapsed laterally to minimum dimensions for storage and/or transport.

A still further objective of this invention is the provision of a wheelchair of the class described which is of simplified construction for economical manufacture.

The foregoing and other objectives and advantages of this invention will appear from the following detailed description, taken in connection with the accompanying drawings of a preferred embodiment.

DESCRIPTION OF THE PREFERRED EMBODIMENT

Figure 2:
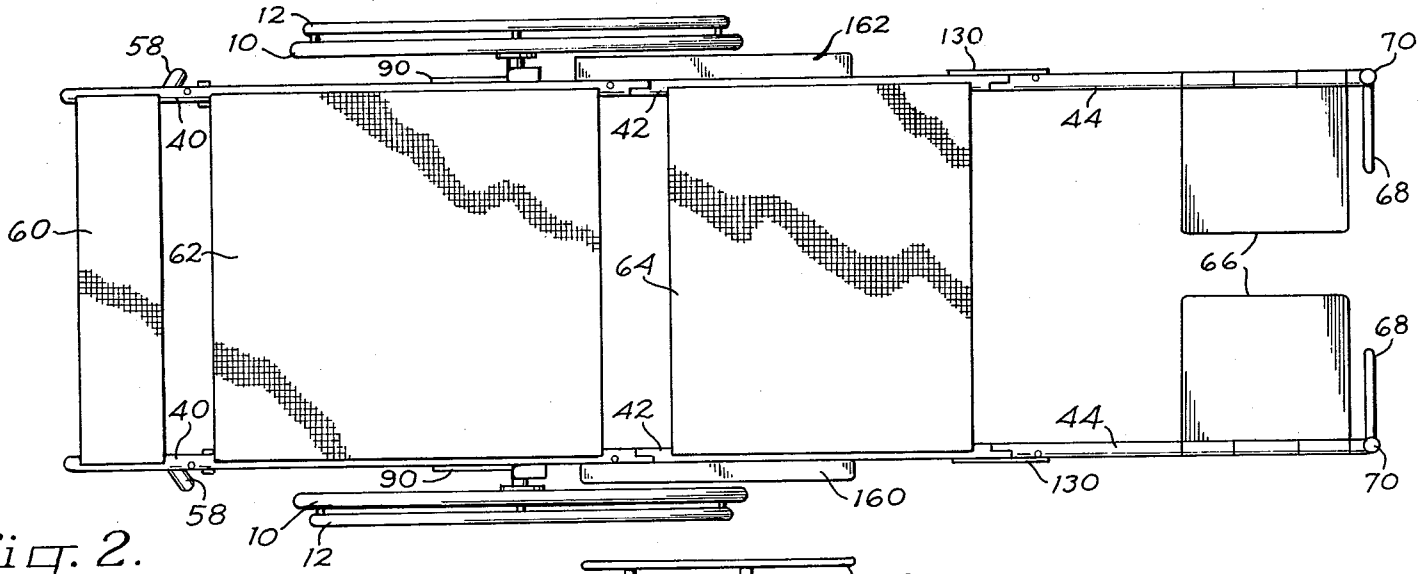
FIG. 2 is a plan view as viewed from the top in FIG. 1.

The wheelchair includes a main frame which is supported for mobility on a pair of laterally spaced rear wheels 10 each supporting a hand drive wheel 12 and each mounted on a fixed stub axle 14, and a pair of front caster wheels 16, as is well known. The main frame includes a pair of laterally spaced frameworks each formed of vertically spaced horizontal frame pieces 18 and 20 interconnected by a rear vertical frame piece 22, front angular frame piece 24 and a diagonal frame piece 26.

Figure 3:
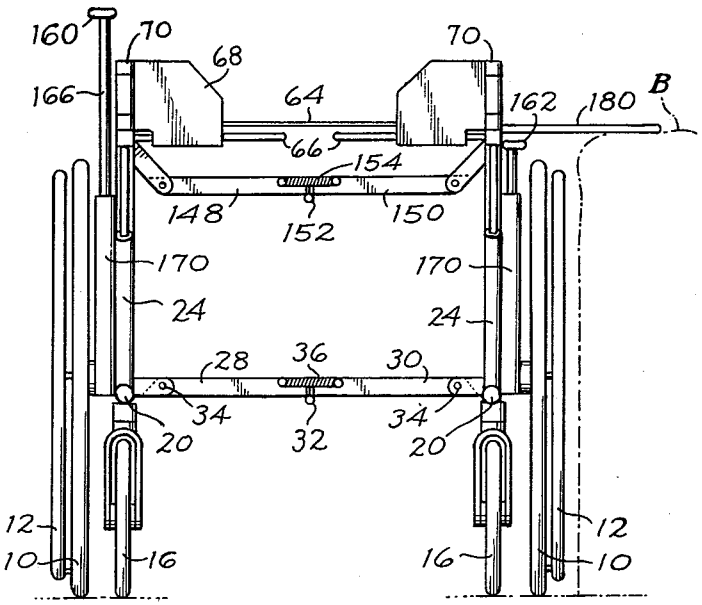
FIG. 3 is a front elevation as viewed from the right in FIG. 1, the chair being shown adjacent a bed with a bridge board spanning the space between the chair and bed.

The laterally spaced frameworks are interconnected for lateral folding by front and rear pairs of transverse bars. As best illustrated in FIG. 3, the bars 28 and 30 of each pair are hinged together at their abutting ends, as by a hinge 32, and the outer ends are connected pivotally one to each of the laterally spaced main frameworks, by pivot pins 34. A coil spring 36 extends across the hinged connection of the bars and is secured at its opposite ends one to each of the bars, to assist the folding and unfolding operations, as discussed hereinafter.

The wheelchair also includes back, seat and leg support sections which, in accordance with this invention, are interconnected for adjustment between positions supporting a patient in upright sitting position and in fully reclining position. In the embodiment illustrated, these sections are formed of a pair of laterally spaced back rest frame segments 40, seat frame segments 42 and leg rest frame segments 44. Each of the back rest frame segments 40 is secured to the upper end of the corresponding vertical frame piece 22 of the associated main framework, by means of a pivot pin 46. The lower, or forward end of each back rest frame segment 40 is secured pivotally to the rearward end of the associated seat frame segment 42, by means of a pivot pin 48. The forward end of each seat frame segment is secured pivotally to the upper, or rearward end of the associated leg rest frame segment 44, by means of a pivot pin 50.

The diagonal frame piece 26 of each lateral framework is provided as a hollow tube which slidably receives a telescoping rod 52 secured at its outer end by means of a pivot pin 54 to a tab 56 projecting downward from the under side of the associated seat frame segment 42 adjacent the forward end of the latter. The seat frame segments thus are supported by the lateral frameworks, as are the back rest frame segments, and they are guided forwardly and upwardly by the rods 52.

The laterally spaced back rest frame segments 40 are provided adjacent their outer ends each with a handle 58 by which an attendant may manipulate the chair. The segments 40 are spanned by a head rest member 60 and a back rest member 62. These preferably are in the form of pieces of flexible fabric to facilitate lateral collapsing or folding of the chair. In similar manner, the laterally spaced seat frame segments 42 are spanned by a seat member 64, also preferably of flexible fabric.

The lower ends of the leg rest frame segments 44 each pivotally mounts a leg support member 66, preferably of rigid material such as metal or wood, arranged to swing outward to allow lateral folding of the chair. Similarly, a pivoted foot support member 68 is mounted and at the lower end of each leg rest segment on a pivot shaft 70 for pivotal movement between a retracted position substantially parallel to the associated leg rest frame segments and an operative, foot-supporting position extending inwardly toward opposite frame segment, as illustrated in FIG. 2.

Means is provided for interconnecting the back rest frame segments 40, the seat frame segments 42 and the leg rest frame segments 44 so that pivoting of the back rest frame segments about the common axis of the pivot pins 46 causes the seat and leg rest frame segments to move in a desired manner. In the embodiment illustrated, this means is provided by the association with each of the laterally spaced group of frame segments, of an assembly of a fixed rear arm 72 secured to each of the back rest frame segments and extending angularly downward therefrom; toward the seat frame segments an elongated link 74 secured at its rearward end to the lower end of the fixed arm 72, by means of a pivot pin 76; and an abutment link bar 78 secured at its lower end pivotally to the forward end of the link 74 by pivot pin 80 and at its upper end pivotally to the forward end of the seat frame segment 42, by means of a pivot pin 82. The abutment bars 78 are disposed in alignment with the associated leg rest frame segments 44.

Figure 1:
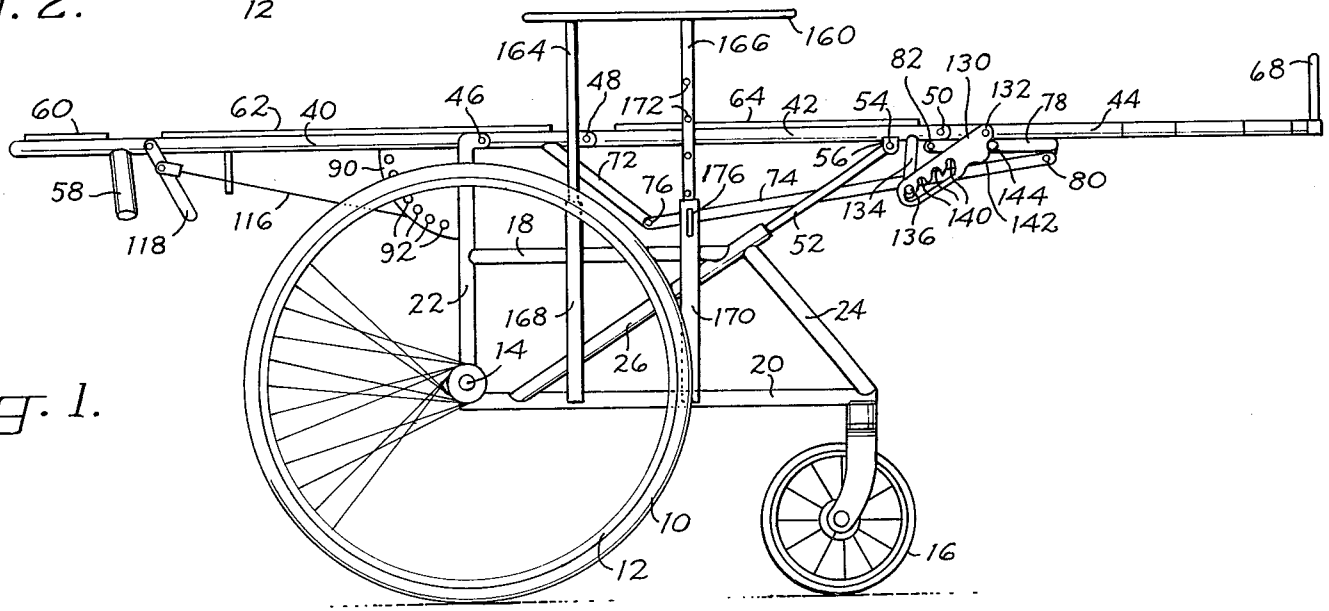
FIG. 1 is a view in side elevation of a wheelchair embodying the features of this invention, the same being shown in fully reclined position.
Figure 4:
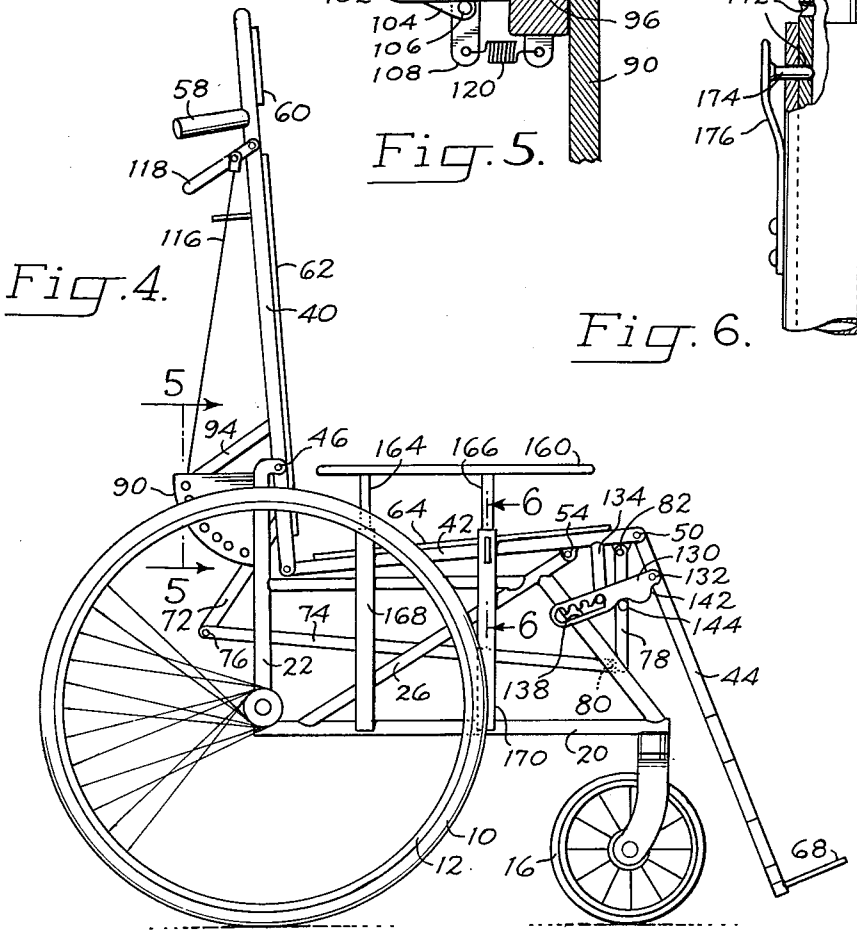
FIG. 4 is a view in side elevation of the chair shown in FIG. 1, but adjusted to the upright sitting position.

Thus, when the back rest frame segments are pivoted counterclockwise from the upright position of FIG. 4 to the horizontal position of FIG. 1, the seat frame segments are moved forward and upward, by outward extension of the telescoping rods 52, and also are pivoted about the pivot pins 48 and 54, into the same horizontal plane as the back rest frame segments. The abutment bars 78 are brought into abutment with the underside of the leg rest frame segments 44 during their forward pivoting movement, whereby to swing the leg rest frame segments upward into the horizontal plane of the back rest and seat frame segments.

The forward movement of the seat and leg frame segments as they are elevated into the horizontal plane of the back rest frame segments, effectively moves the center of gravity of the reclining patient into a more stabilizing position between the wheels of the chair.

Conversely, when the back rest frame segments are provided clockwise from the horizontal position of FIG. 1 to the upright position of FIG. 4, the reverse movements of the assembly of components just described occurs.

Means also is provided for securing the patient-supporting frame segments in any of the desired number of positions of adjustment between the upright sitting and fully reclining positions. In the embodiment illustrated, this is provided by a locking quadrant plate 90 secured to and extending rearwardly from each of the vertical frame pieces 22. The quadrant plate is provided with a plurality of openings 92 spaced apart on a common arc, with the pivot pin 46 as its center. A bracket 94 extending rearwardly from the associated back rest frame segment 40 is provided with a transverse opening 96 (FIG. 5) which slidably receives a locking pin 98. One end of the locking pin projects retractably from the bracket for registration with any one of the plurality of openings 92, and the opposite end of the pin is secured to an extension 100 the outer end of which is connected pivotally, as by a pivot pin 102, to one end of a link 104. The opposite end of the link is connected pivotally, by means of a pivot pin 106, to one arm 108 of a bell crank lever. A second arm 110 of the bell crank lever is mounted pivotally on a pivot pin 112 secured to the bracket 94. A third arm 114 of the bell crank lever is connected to one end of an elongated operating member 116 in the form of a rod, cable, or other form of flexible or rigid line. The opposite end of the line is connected to an intermediate point on a hand lever 118 mounted pivotally at one end on the associated back rest frame segment 40 adjacent the handle 58.

Thus, by engaging the hand levers 118 with the fingers of the hands engaging the handles 58 and pulling upward on the hand levers, the locking pins 98 are retracted from the quadrant plate openings 92, thereby releasing the back rest frame segments for pivotal movement about their pivot pins 46 to any position of adjustment between the limits previously described.

Figure 5:
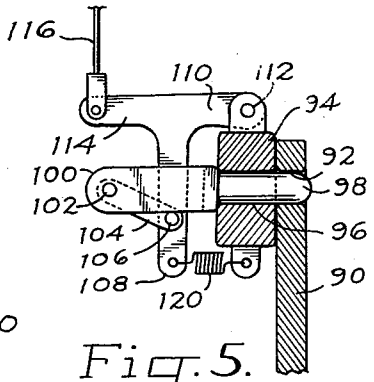
FIG. 5 is a fragmentary sectional view of the chair position locking mechanism, taken on the line 5—5 in FIG. 4.

A spring 120 interconnects the arm 108 of the bell crank lever and the bracket 94, to urge the locking pin assembly resiliently toward the locking position illustrated in FIG. 5. Accordingly, release of the hand levers urges the locking pins toward the adjusting quadrant plates, whereupon registration of one of the openings in the latter causes the pins to enter them and secure the back rest frame segments in the desired position of angular adjustment.

Means is provided for adjusting each of the leg rest frame segments 44 angularly relative to the associated seat frame segment 42 when the chair is in any position other than fully reclining. In the embodiment illustrated, this is provided by an adjusting brace 130 associated with each leg rest frame segment and secured to the latter by means of a pivot pin 132. A bar 134 projecting downward from the associated seat rest frame segment is provided with an outwardly extending pin 136 which projects through an elongated slot 138 in the brace. The upper surface of the slot is formed as a plurality of deep semi-circular notches 140 into which the pin 136 may be seated selectively. This is achieved by pivoting the brace upwardly to release the pin from any one of the notches, then swinging the associated leg rest frame segment about its connecting pivot pin 50 to the desired position of angular adjustment. The brace then is allowed to drop by gravity so that the pin is engaged in a registering notch. By this means each of the laterally spaced leg rest frame segments is adjustable independently of the other.

With the pin 136 located at the inner end of the slot 138, the leg rest frame sections 44 are positioned in their downwardmost angular position shown in FIG. 4. In this position the sections 44 are held forwardly of the caster wheels so as not to interfere with their movement. With the pin located at the outer end of the slot 138, the leg rest frame sections are positioned in the same place as the seat frame sections 42.

Means is provided for releasing the leg rest frame sections 44 from any position of angular adjustment relative to the seat frame sections automatically when the chair is adjusted to the fully reclining position of FIG. 1. In the embodiment illustrated, this means is provided by a cam lobe 142 on each brace 130 arranged to be engaged by a cam follower pin 144 on the associated abutment bar 78 as the latter approaches engagement with the frame segments 44. This engagement results in pivoting of the brace 130 about its pivot pin 132 in the direction to retract the notches from the pin 136. The abutment bar 78 then proceeds forwardly and upward, pushing the frame segments 44 to the horizontal plane of the segments 40 and 42, whereupon the pin 136 abuts the outer end of slot 138.

When the chair is to be returned to upright position, the pin 144 retracts along the cam lobe 142 to keep the notches 140 away from the pin 136 until the leg rest frame segments 44 are returned to the lowered position of FIG. 4, whereupon the pin 144 moves away from the cam lobe and the brace 130 swings downward by gravity to register the pin 136 in the innermost notch 140.

Figure 9:
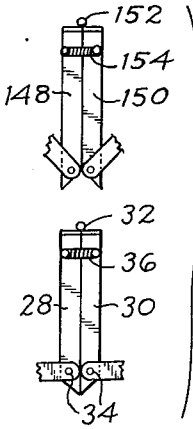
FIG. 9 is a fragmentary view in front elevation showing the folding mechanism used to fold the chair for storage, the mechanism being shown in the folded position as compared with the unfolded position illustrated in FIG. 3.

A pair of transverse interconnecting bars 148 and 150 pivotally interconnect the pair of laterally spaced fixed arms 72, the pair of bars being connected together at their adjacent ends by means of a hinge 152 and spring 154, in the manner of the pair of bars 28 and 30 previously described. These pairs of bars allow lateral collapsing of the laterally spaced frame assemblies, to reduce the lateral dimensions of the wheelchair to a minimum, for convenient storage or transport. As illustrated in FIG. 9, this transverse collapsing of the wheelchair is achieved by swinging the pairs of hinged bars upward at their hinges 32 and 152 while simultaneously drawing the laterally spaced frame and wheel assemblies together, until the pairs of bars are brought to the vertical positions illustrated in FIG. 9. The springs 36 and 154 assist in maintaining the collapsed condition of the chair and also in maintaining the interconnected bars in extended position when the chair is expanded laterally to operative condition.

Figure 6:
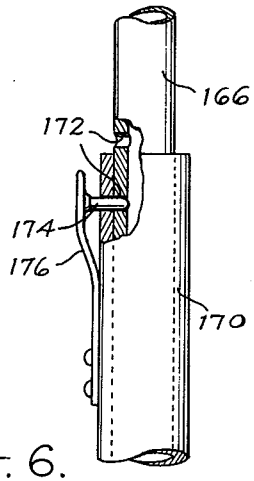
FIG. 6 is a fragmentary sectional view taken on the line 6—6 in FIG. 4.

The wheelchair also is provided with a pair of laterally spaced arm rests 160 and 162. These are adjustable vertically by any suitable means. In the embodiment illustrated, each of the arm rests is provided with a pair of spaced rods 164 and 166 which project downward from the underside of the rests and are slidably received telescopically within hollow tubes 168 and 170, respectively, secured to the horizontal frame pieces 18 and 20 of the associated laterally spaced frameworks. As illustrated in FIG. 6, one of the rods (166) of each arm rest is provided with a plurality of longitudinally spaced openings 172 arranged to removably receive a locking pin 174 projecting inward from a spring element 176 secured to the outer side of the associated tube 170. By pulling outward on the spring, the pin 174 is retracted from a registering opening 172 in the rod to allow vertical adjustment of the associated arm rest, as will be understood.

The arm rests may serve additionally as guard rails to confine a patient therebetween when the wheelchair is adjusted to the fully reclining position.

It is to be noted from FIG. 1 that the fully reclining position locates the back rest, seat and leg rest frame segments in a horizontal plane elevated above the wheels and above the position of the seat frame segments when in the upright sitting position illustrated in FIG. 4. This position of elevation in the fully reclining position preferably is chosen to correspond with the height of a hospital bed B, as illustrated in FIG. 3.

With the wheelchair positioned closely adjacent the bed, the space between the patient-supporting frame sections and the bed may be spanned by a bridge board 180. The bridge board preferably is provided in three longitudinal sections each substantially matching the length of the associated back rest, seat and leg rest frame segments, and preferably hinged together at their abutting ends so as to enable folding of the three sections together to minimum dimensions for convenient storage in a compartment (not shown) provided in the back of the back rest member 62.

Figures 7, 8:
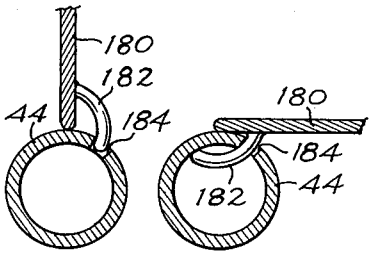
FIGS. 7 and 8 are fragmentary sectional views illustrating the manner in which the bridge board is secured removably to the chair in the fully reclined position of the latter.

The bridge board is secured removably to the adjacent back rest, seat and leg rest frame segments adjacent one longitudinal edge of the bridge board. In the embodiment illustrated, this is achieved by providing each of the bridge board sections with one or more arcuate pins 182 projecting downward and outward from adjacent said longitudinal edge, for removable entry into registering openings 184 in the frame segments. FIG. 7 of the drawings illustrates the initial stage of reception of the arcuate pins into the openings, by disposing the bridge board vertically on edge above the frame segments with the outer end of the arcuate pins just entering the corresponding openings. With the adjacent arm rest 162 lowered, the bridge board then is swung downward and laterally outward through 90° to the position illustrated in FIG. 8, whereupon the bridge board is anchored to the frame segments and extends laterally outward therefrom for support along its outer side on the adjacent bed.

With the wheelchair adjusted to the fully reclining position and the bridge board installed as illustrated in FIG. 3, transfer of a patient from the bed to the reclining wheelchair may be accomplished simply by the use of an ordinary pull sheet, by which the reclining patient is slid across the bridge board and onto the reclining wheelchair, without requiring any exertion or other participation by the patient.

During transfer of a patient from the bed to the reclining wheelchair, the arm rest 162 adjacent the bed is retracted below the level of the horizontally disposed patient-supporting frame segments, as previously mentioned and as illustrated in FIG. 3. The outboard arm rest 160 may be adjusted to the elevated position, however, to serve as a guard rail, as previously explained.

With the patient now reclining on his back on the horizontally disposed frame segments and the arm rest 162 elevated, an attendant grasps the control handles 58 projecting from the back rest frame segments 40, pulls on the hand levers 118 to retract the locking pins 98 from the quadrant plates 90 and then swings the back rest frame segments clockwise about the pivot pins 46 (FIG. 1), with minimum effort, to bring the wheelchair to the upright sitting position illustrated in FIG. 4. During this movement the link 78 is retracted from abutment with the underside of the leg rest frame segments. Since the adjusting braces 130 are held upward to disengage the pins 136 from the notches 140, the leg rest frame segments swing downward to the lowermost position of adjustment as previously explained.

To return a patient from the upright sitting position to the fully reclining position, the hand levers 118 are pulled rearward to disengage the locking pins 98 from the quadrant plate 90. The attendant then pulls rearward on the handles 58 to pivot the back rest frame segments counterclockwise about their pivot pins 46 until the back rest is brought to the horizontal position illustrated in FIG. 1. The leg rest frame segments also are swung upward to horizontal position by action of the cam lobes 142 and pins 144, as explained hereinbefore.

It will be apparent to those skilled in the art that various changes may be made in the size, shape, number, type and arrangement of parts described hereinbefore, without departing from the spirit of this invention.

Having now described our invention and the manner in which it may be used, we claim:

1. A wheelchair comprising:

(a) a frame supported on front and rear wheels, (b) a back rest support having front and rear ends and mounted pivotally intermediate its ends on the frame above the wheels thereof for movement between a horizontal, patient reclining position and an inclined, patient sitting position, (c) a seat support having front and rear ends and connected pivotally at its rearward end to the forward end of the back rest support, (d) a seat mounting member on the frame connected pivotally to the seat support adjacent the forward end thereof and movable upwardly and forwardly relative to the frame during movement of the back rest support from said patient sitting position to said patient reclining position, for aligning said back rest and seat supports in a common horizontal plane while simultaneously moving the seat support forwardly, the seat mounting member comprising a rod connected pivotally at one end to the seat support adjacent the forward end thereof and slidable telescopically within a tubular rod support member forming a rigid part of the frame and disposed at an upwardly and forwardly inclined angle relative to horizontal, and (e) a leg rest support having front and rear ends and connected pivotally at its rearward end to the forward end of the seat support for pivotal movement relative to the seat support independently of the back rest support.

2. A wheelchair comprising:

(a) a frame supported on front and rear wheels, (b) a back rest support having front and rear ends and connected pivotally to the wheeled frame on a transverse pivot axis disposed above the wheels, (c) a seat support having front and rear ends and connected to the back rest support on a transverse pivot axis, (d) a seat mounting member on the frame connected pivotally to the seat support and movable upwardly relative to the frame, (e) a leg rest support connected to the seat support on a transverse pivot axis, (f) the back rest, seat and leg rest supports thereby being mounted on the frame for adjusting said supports between a patient reclining position in which said supports are disposed in a common horizontal plane above the wheels of the frame and a patient sitting position in which the back rest support extends upwardly from the rear end of the seat support and the leg rest support extends downwardly from the front end of the seat support, (g) link means operatively interengaging the back rest support and leg rest support for moving the leg rest support by moving the back rest support, (h) adjustment means interengaging the seat support and leg rest support for adjusting the angular relationship therebetween, and (i) adjustment release means on the link means arranged to engage the adjustment means when the link means operatively engages the leg rest support, for releasing the adjustment means from said interengaging to allow movement of the leg rest support relative to the seat support by movement of the back rest support.

3. The wheelchair of claim 2 wherein the adjustment release means includes cam means on the adjustment means and cam follower means on the link means arranged for mutual engagement when the link means operatively engages the leg rest support, for releasing the adjustment means from said interengagement to allow movement of the leg rest support relative to the seat support by movement of the back rest support.

4. A wheelchair comprising:

(a) a frame supported on front and rear wheels, (b) a back rest support having front and rear ends and connected pivotally intermediate its ends to the wheeled frame on a transverse pivot axis disposed above the wheels, (c) a seat support having front and rear ends and connected to the back rest support on a transverse pivot axis, (d) a seat mounting member on the frame movable upwardly and forwardly relative thereto and connected pivotally to the seat support, (e) a leg rest support connected to the seat support on a transverse pivot axis, (f) the back rest, seat and leg rest supports thereby being mounted on the frame for adjusting said supports between a patient reclining position in which said supports are disposed in a common horizontal plane above the wheels of the frame and a patient sitting position in which the back rest support extends upwardly from the rest end of the seat support and the leg rest support extends downwardly from the front end of the seat support, (g) link means operatively interengaging the back rest support and leg rest support for moving the leg rest support by moving the back rest support, (h) adjustment means interengaging the seat support and leg rest support for adjusting the angular relationship therebetween, (i) adjustment release means on the link means arranged to engage the adjustment means when the link means operatively engages the leg rest support, for releasing the adjustment means from said interengagement to allow movement of the leg rest support relative to the seat support by movement of the back rest support, (j) locking means releasably interengaging the wheel frame and one of the supports for securing the supports in positions of adjustment between said patient reclining and sitting positions, and (k) laterally spaced arm rest mounted on the wheeled frame on opposite sides of the seat support for vertical adjustment between the retracted position below the patient reclining position of the supports and an elevated position above the patient reclining position of the supports, whereby the arm rests serve the additional function of retractable side guard rails in the patient reclining position of the supports.

5. A wheelchair comprising:

(a) a frame supported on front and rear wheels, (b) a back rest support having front and rear ends and mounted pivotally intermediate its ends on the frame above the wheels thereof for movement between a horizontal, patient reclining position and an inclined, patient sitting position, (c) a seat support having front and rear ends and connected pivotally at its rearward end to the forward end of the back rest support, (d) a seat mounting member on the frame connected pivotally to the seat support adjacent the forward end thereof and movable upwardly and forwardly relative to the frame during movement of the back rest support from said patient sitting position to said patient reclining position, for aligning said back rest and seat supports in a common horizontal plane, (e) a leg support having front and rear ends and connected pivotally at its rearward end to the forward end of the seat support for pivotal movement relative to the seat support independently of the back rest support, and (f) a rearward link connected pivotally at its rearward end to the back rest support and a forward link connected pivotally at one end to the forward end of the rearward link and at the opposite end pivotally to the seat support, the forward link being arranged to be spaced rearwardly of the leg rest support when the back rest support is in patient sitting position and to abut the leg rest support during movement of the back rest support to patient reclining position, whereby to move the leg rest support to patient reclining position.

* * * * *

UNITED STATES PATENT OFFICE

CERTIFICATE OF CORRECTION

PATENT NO. : 4,079,990

DATED : 21 March, 1978

INVENTOR(S) : Earl E. McMunn and Ronald N. McMunn

It is certified that error appears in the above-identified patent and that said Letters Patent are hereby corrected as shown below:

Column 3, line 12 after "toward" insert --the--.

Column 3, line 24 after "segments" insert --; --.

8, line 29 "rest" should read --rear--.

8, line 49 "rest" should read --rests--.

9, line 9 after "leg" insert --rest--.

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*